US008095022B2

(12) United States Patent
Fujishiro

(10) Patent No.: US 8,095,022 B2
(45) Date of Patent: Jan. 10, 2012

(54) IMAGE FORMING APPARATUS CAPABLE OF CALCULATING AMOUNT OF TONER ADHESION ACCURATELY

(75) Inventor: Wataru Fujishiro, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 182 days.

(21) Appl. No.: 12/720,618

(22) Filed: Mar. 9, 2010

(65) Prior Publication Data

US 2010/0329706 A1 Dec. 30, 2010

(30) Foreign Application Priority Data

Jun. 30, 2009 (JP) ..... 2009-155768

(51) Int. Cl.
*G03G 15/01* (2006.01)

(52) U.S. Cl. ..... 399/28; 399/40; 399/49

(58) Field of Classification Search ..... 347/115, 347/232; 399/15, 27, 28, 39, 40, 49, 231
See application file for complete search history.

(56) References Cited

U.S. PATENT DOCUMENTS

| | | | |
|---|---|---|---|
| 2004/0009014 | A1 | 1/2004 | Takahashi et al. |
| 2005/0025526 | A1 | 2/2005 | Takahashi et al. |
| 2006/0140650 | A1 | 6/2006 | Yokote |
| 2006/0203268 | A1 | 9/2006 | Okuyama |

FOREIGN PATENT DOCUMENTS

| | | | |
|---|---|---|---|
| JP | H06-011969 | A | 1/1994 |
| JP | H09-054474 | A | 2/1997 |
| JP | H11-125978 | A | 5/1999 |
| JP | 2001-067200 | A | 3/2001 |
| JP | 2004-045700 | A | 2/2004 |
| JP | 2006-154413 | A | 6/2006 |
| JP | 2006-171138 | A | 6/2006 |
| JP | 2006-251809 | A | 9/2006 |

OTHER PUBLICATIONS

Japan Patent Office, Decision to Grant a Patent for Japanese Patent Application No. 2009-155768 (counterpart to above-captioned patent application), mailed May 19, 2011.

*Primary Examiner* — Mark R Gaworecki
(74) *Attorney, Agent, or Firm* — Baker Botts L.L.P.

(57) ABSTRACT

A forming-dot counting section counts a number of dots of a subject color based on dot pattern data of the subject color. An overlapping-dot counting section compares the dot pattern data of the subject color and the dot pattern data of at least one other color of which dots are formed prior to the subject color, and counts a number of overlapping dots of the subject color that are formed in an overlapping relation with the dots of the at least one other color. A calculating section calculates the amount of adhering toner of the subject color by subtracting an estimated amount of non-adhering toner from an estimated amount of adhering toner. The estimated amount of adhering toner is estimated based on the number of dots of the subject color. The estimated amount of non-adhering toner is estimated based on the number of overlapping dots.

19 Claims, 9 Drawing Sheets

IMAGE FORMING APPARATUS CAPABLE OF CALCULATING AMOUNT OF TONER ADHESION ACCURATELY

CROSS REFERENCE TO RELATED APPLICATIONS

This application claims priority from Japanese Patent Application No. 2009-155768 filed Jun. 30, 2009. The entire content of the priority application is incorporated herein by reference.

TECHNICAL FIELD

The invention relates to an image forming apparatus.

BACKGROUND

Image forming apparatuses for forming images by depositing toner on recording mediums are conventionally known. An image forming apparatus estimates the amount of toner adhering to a recording medium (toner adhesion amount) based on density of images of an original document (original-document image density). This image forming apparatus preliminary stores correlation between the toner adhesion amount and the original-document image density, and estimates the toner adhesion amount for each dot based on the original-document image density of the dot.

SUMMARY

In image forming apparatuses, some dots are formed overlappingly on other dots that are already formed.

In the above-described image forming apparatus, if the original-document image density is the same, then the estimated toner adhesion amount will also be the same between the cases when dots are formed directly on a recording medium and when dots are formed overlappingly on other dots that are already formed.

However, adhesion of toner is more difficult when dots are formed overlappingly on other dots that are already formed, than when dots are formed directly on a recording medium. Hence, the above-described image forming apparatus has a problem that accuracy of estimating a toner adhesion amount deteriorates if there are dots that are formed overlappingly on other dots that are already formed.

In view of the foregoing, it is an object of the invention to provide an image forming apparatus capable of calculating an amount of toner adhesion accurately.

In order to attain the above and other objects, the invention provides an image forming apparatus. The image forming apparatus includes a first storage section, a dot forming section, a forming-dot counting section, a overlapping-dot counting section, and a calculating section. The first storage section is configured to store dot pattern data generated for each of a plurality of colors of toner. The dot forming section is configured to form dots of each of the plurality of colors on a recording medium, based on the dot pattern data stored in the first storage section. The forming-dot counting section is configured to count a number of dots of a subject color based on the dot pattern data of the subject color. The subject color is a color for which an amount of toner adhering to the recording medium is calculated. The overlapping-dot counting section is configured to compare the dot pattern data of the subject color and the dot pattern data of at least one other color of which dots are formed prior to the subject color, and to count a number of overlapping dots of the subject color that are formed in an overlapping relation with the dots of the at least one other color. The calculating section is configured to calculate the amount of adhering toner of the subject color by subtracting an estimated amount of non-adhering toner from an estimated amount of adhering toner. The estimated amount of adhering toner is estimated based on the number of dots of the subject color. The estimated amount of non-adhering toner is estimated based on the number of overlapping dots.

According to another aspect, the invention provides an image forming apparatus. The image forming apparatus includes a first storage section, a dot forming section, a forming-dot counting section, a overlapping-dot counting section, and a calculating section. The first storage section is configured to store dot pattern data generated for each of a plurality of colors of toner. The dot forming section is configured to form dots of each of the plurality of colors on a recording medium, based on the dot pattern data stored in the first storage section. The forming-dot counting section is configured to count a number of dots of a subject color based on the dot pattern data of the subject color. The subject color is a color for which an amount of toner adhering to the recording medium is calculated. The overlapping-dot counting section is configured to compare the dot pattern data of the subject color and the dot pattern data of at least one other color of which dots are formed prior to the subject color, to detect dots of the at least one other color that exist within predetermined ranges of respective dots of the subject color, and to count an expectation value based on probability that the respective dots of the subject color overlap with detected dots of the at least one other color as a number of overlapping dots. The calculating section is configured to calculate the amount of adhering toner of the subject color by subtracting an estimated amount of non-adhering toner from an estimated amount of adhering toner. The estimated amount of adhering toner is estimated based on the number of dots of the subject color. The estimated amount of non-adhering toner is estimated based on the number of overlapping dots.

According to still another aspect, the invention provides an image forming apparatus. The image forming apparatus includes first storage means for storing dot pattern data generated for each of a plurality of colors of toner; dot forming means for forming dots of each of the plurality of colors on a recording medium, based on the dot pattern data stored in the first storage means; forming-dot counting means for counting a number of dots of a subject color based on the dot pattern data of the subject color, the subject color being a color for which an amount of toner adhering to the recording medium is calculated; overlapping-dot counting means for comparing the dot pattern data of the subject color and the dot pattern data of at least one other color of which dots are formed prior to the subject color, and for counting a number of overlapping dots of the subject color that are formed in an overlapping relation with the dots of the at least one other color; and calculating means for calculating the amount of adhering toner of the subject color by subtracting an estimated amount of non-adhering toner from an estimated amount of adhering toner, the estimated amount of adhering toner being estimated based on the number of dots of the subject color, the estimated amount of non-adhering toner being estimated based on the number of overlapping dots.

BRIEF DESCRIPTION OF THE DRAWINGS

Embodiments in accordance with the invention will be described in detail with reference to the following figures wherein.

DETAILED DESCRIPTION

First Embodiment

An image forming apparatus according to a first embodiment of the invention will be described while referring to FIGS. 1 through 4.

(1) Configuration of image forming apparatus

The configuration of the image forming apparatus according to the first embodiment will be described. The image forming apparatus of the first embodiment is applied to a laser printer 10.

The laser printer 10 is a so-called direct-tandem-type color laser printer that includes four developing rollers 31K, 31C, 31M, and 31Y and four photosensitive drums 32K, 32C, 32M, and 32Y for each color of K (black), C (cyan), M (magenta), and Y (yellow), and the like.

Figure 1:
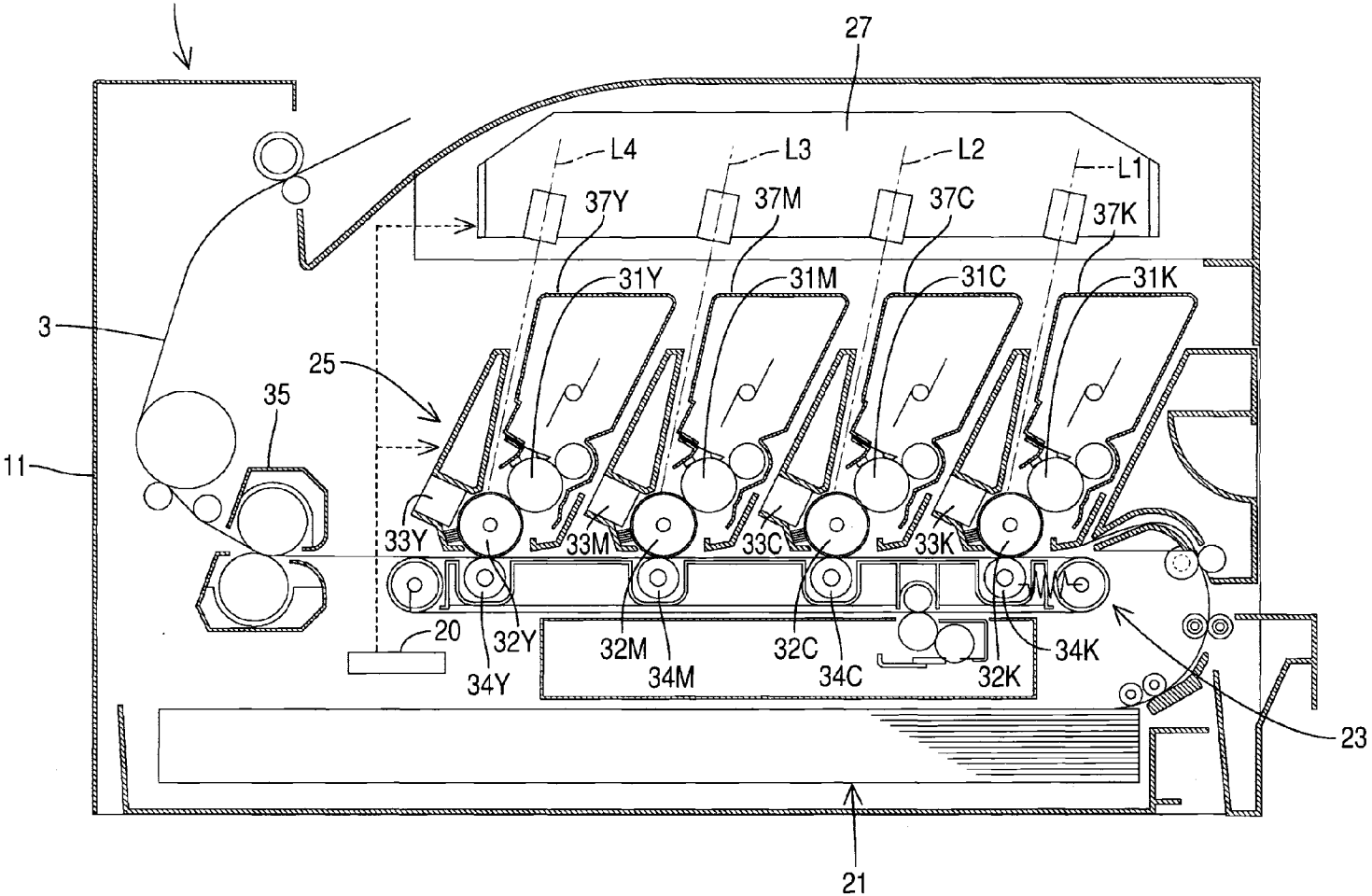
FIG. 1 is a side cross-sectional view showing the relevant parts of an image forming apparatus according to a first embodiment of the invention.

Note that, in the following description, the expression "front" is used to define the right-hand side in FIG. 1. Further, the image forming apparatus is not limited to a color laser printer, but may be an LED printer or a so-called multifunction device having a facsimile function and a copy function, for example.

The laser printer 10 includes a main casing 11 formed in a box-like shape. Within the main casing 11, a paper feeding section 21, a paper conveying section 23 that conveys paper 3, an image forming section 25 that forms an image by an electrophotographic method, and a scanner section 27 are arranged so as to be stacked from the bottom in this order.

A control board 20 is provided within the main casing 11. The control board 20 includes a CPU 20*a* (see FIG. 2) that controls each section of the laser printer 10.

The image forming section 25 includes developing rollers 31 (31K-31Y), photosensitive drums 32 (32K-32Y), charging units 33 (33K-33Y), transfer rollers 34 (34K-34Y), a fixing unit 35, and the like. The fixing unit 35 thermally fixes a toner image transferred on paper 3 to a surface of paper. Each charging unit 33 is a so-called Scorotron charger and has a charging wire and a grid electrode (not shown).

The scanner section 27 includes four polygon mirrors (not shown) for each color, four laser diodes 40 (see FIG. 2) for each polygon mirror, a controller 41 (see FIG. 2) that controls the laser diodes 40, and four light receiving sensors 43 (see FIG. 2) for each laser diode 40.

Laser lights L1-L4 emitted from each laser diode 40 are deflected by the polygon mirrors, and their directions are subsequently changed by optical elements such as reflection mirrors arranged on the light paths. As shown in FIG. 1, the laser lights L1-L4 are then irradiated onto the surfaces of the photosensitive drums 32 by high-speed scanning. In this way, electrostatic latent images are formed on the photosensitive drums 32.

The electrostatic latent images formed on the photosensitive drums 32 are developed by toner supplied from toner cartridges 37 (37K-37Y), and are transferred onto paper 3 that is conveyed along a paper conveying path by the paper conveying section 23. In this way, dots are formed on paper 3.

The above-described four light receiving sensors 43 are arranged adjacent to the respective ones of the photosensitive drums 32. Each light receiving sensor 43 receives a laser light emitted from a corresponding one of the laser diodes 40 and outputs a BD (Beam Detect) signal to the controller 41.

(2) Electrical configuration of laser printer

Figure 2:
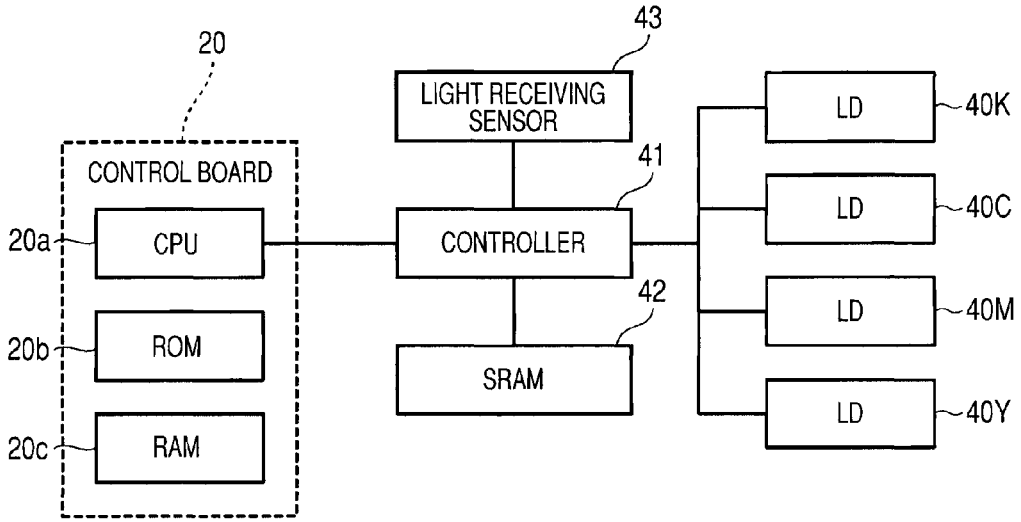
FIG. 2 is a block diagram showing the electrical configuration of the image forming apparatus.

In the block diagram of FIG. 2, only the control board 20, the controller 41, an SRAM 42, light receiving sensors 43, and the laser diodes 40 (40K-40Y) are shown, and other elements are omitted for simplification.

The control board 20 includes the CPU 20*a* that controls each section of the laser printer 10, a ROM 20*b* that stores programs for the CPU 20*a* to execute various processes, and a RAM 20*c* used as a main storage device which is used by the CPU 20*a* for executing the various processes.

The CPU 20*a* performs a halftone process to image data acquired through an interface (I/F) section (not shown) by using the dither method, the error diffusion method, or the like, to generate halftone data (an example of dot pattern data; hereinafter referred to as "dot pattern data") for each color of toner. Upon generating dot pattern data for each color, the CPU 20*a* stores generated dot pattern data in the RAM 20*c*. Alternatively, it may be so configured that the CPU 20*a* does not generate dot pattern data but that the interface section receives dot pattern data generated by an external device.

The controller 41 is an ASIC that controls an electric current supplied to the laser diodes 40, based on dot pattern data outputted from the CPU 20*a*.

When a BD signal is outputted from the light receiving sensor 43, the controller 41 outputs a synchronization signal to the CPU 20*a*. Each time a synchronization signal is outputted, the CPU 20*a* acquires dot pattern data for one line from dot pattern data for the color corresponding to the light receiving sensor 43, and outputs the dot pattern data for one line to the controller 41. The controller 41 turns on and off an electric current supplied to the laser diode 40 based on the dot pattern data for one line outputted from the CPU 20*a*, thereby controlling the laser diode 40 to blink on and off.

In the present embodiment, a case is described where the controller 41 calculates the amount of toner adhering to paper 3 (toner adhesion amount), as an example.

The SRAM 42 is directly accessible from the controller 41, without involving a memory controller.

(3) Counting of dots and counting of overlapping dots

Figure 3:
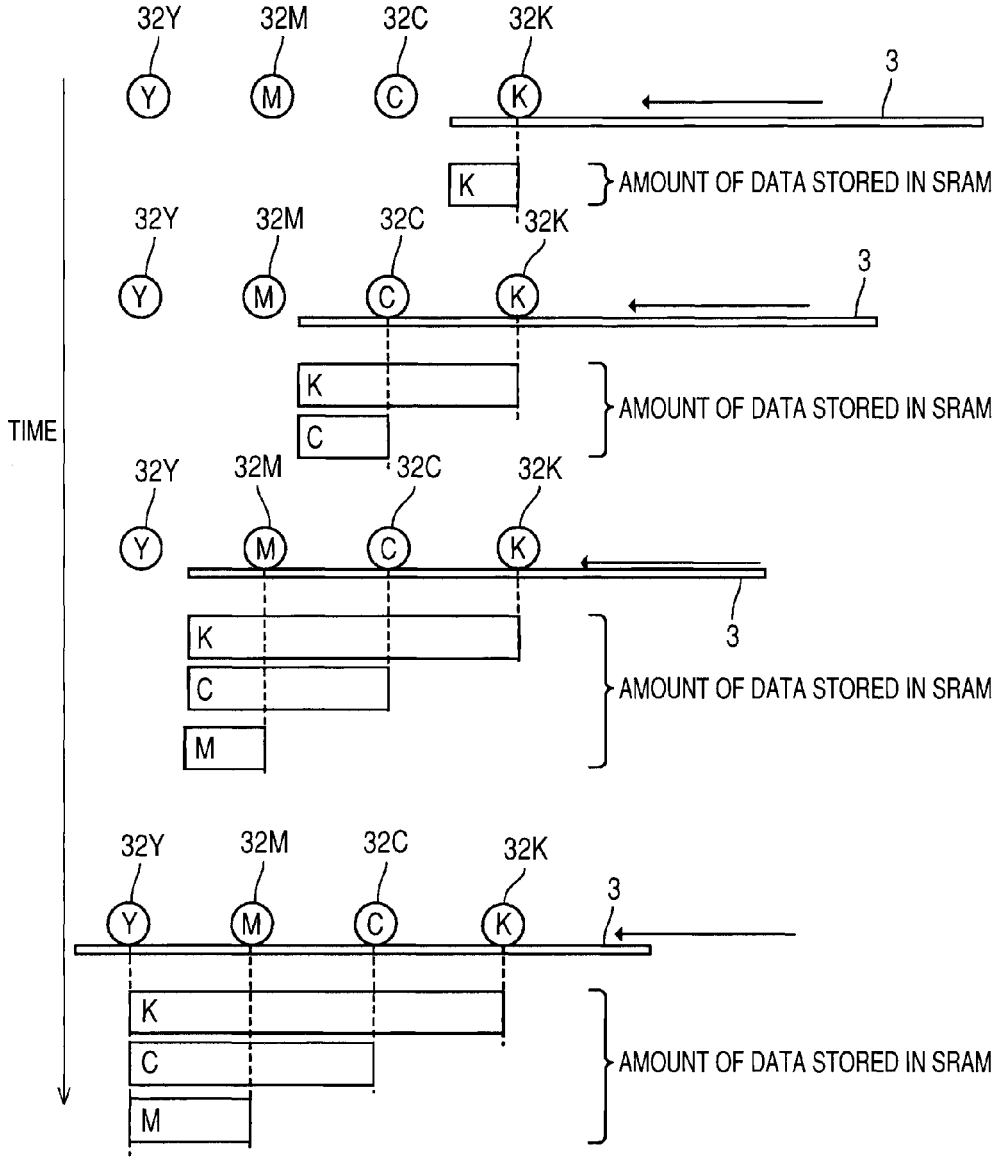
FIG. 3 is an explanatory diagram showing dot pattern data stored in an SRAM.

FIG. 3 schematically shows dot pattern data stored in the SRAM 42 for counting overlapping dots.

Dot pattern data of black (K) are explained, as an example. When the CPU 20*a* outputs dot pattern data for the first line of K, the controller 41 forms dots on paper 3 based on the outputted dot pattern data for the first line, and also counts the number of dots of K based on the dot pattern data for the first line. The controller 41 counts the number of dots each time the CPU 20*a* outputs dot pattern data of K for one line, and adds up the number of dots counted for each line, thereby counting the number of dots of K.

In the case of dot pattern data of C, like the case of K, the controller 41 performs forming of dots and counting of the number of dots. In addition, the controller 41 compares dot pattern data for one line of C outputted from the CPU 20*a* and dot pattern data for one line of K for which dots are formed on the same line on paper 3, and counts the number of dots (overlapping dots) of C (the subject color) that are formed overlappingly on dots of K (other color). Each time the CPU 20*a* outputs dot pattern data of C, the controller 41 counts the number of overlapping dots and adds up the number of overlapping dots counted for each line, thereby counting the number of overlapping dots of C.

This process is similar for M and Y. In the case of M, the controller 41 counts the number of overlapping dots that are formed overlappingly on dots of K or C. In the case of Y, the controller 41 counts the number of overlapping dots that are formed overlappingly on dots of K, C, or M.

In order to count the number of overlapping dots of C, dot pattern data of K are necessary. Hence, when the controller 41 forms dots based on dot pattern data for one line of K, the controller 41 stores the dot pattern data of K in the SRAM 42.

Because dots of M can overlap with dots of K and dots of C, dot pattern data of K and C are required for counting overlapping dots of M. Similarly, dot pattern data of K, C and M are required for counting overlapping dots of Y. Thus, the controller 41 also stores dot pattern data of C and M in the SRAM 42.

The storage capacity of the SRAM 42 required for storing dot pattern data of K, C and M can be obtained as follows.

First, the storage capacity required for storing dot pattern data of K will be explained. Assume that the distance between the rotational axes of the two adjacent photosensitive drums 32 (the drum pitch) is 65 millimeters (mm) Then, the distance between the rotational axis of the photosensitive drum 32K and the rotational axis of the photosensitive drum 32Y is: 65 mm×3=195 mm.

Assuming that the resolution (the number of lines per inch) in the sub-scanning direction is 600 dpi, the number of lines formed in the distance of 195 mm is: (195/25.4)×600=4606 lines.

Assuming that the width in the main scanning direction is 215.9 mm, the number of dots in the main scanning direction is: (215.9/25.4)×600=5100 dots.

Thus, if one dot is represented by one bit, the storage capacity required for storing dot pattern data of K is: 5100×4606 dots=23490600 bits=2.80 megabytes (MByte).

The distance between the rotational axis of the photosensitive drum 32C and the rotational axis of the photosensitive drum 32Y is two thirds (⅔) of the distance between the rotational axis of the photosensitive drum 32K and the rotational axis of the photosensitive drum 32Y. Hence, 2.80×⅔=1.87 MByte.

The distance between the rotational axis of the photosensitive drum 32M and the rotational axis of the photosensitive drum 32Y is one third (1;3) of the distance between the rotational axis of the photosensitive drum 32K and the rotational axis of the photosensitive drum 32Y. Hence, 2.80×⅓=0.93 MByte.

Accordingly, by adding these amounts, the storage capacity required for the SRAM 42 is 5.60 (=2.80+1.87+0.93) MByte.

After the number of overlapping dots is counted for dot pattern data for one line of Y, dot pattern data for one line of K, C, and M corresponding to the dot pattern data for that one line of Y become unnecessary. When the dot pattern data for one line of K, C, and M become unnecessary, the controller 41 overwrites (replaces) the unnecessary dot pattern data of K, C, and M with dot pattern data for one line of K, C, and M, respectively, that are subsequently outputted from the CPU 20*a*. In this way, the SRAM 42 can be used efficiently, and the storage capacity of the SRAM 42 can be reduced.

(4) Image forming operation

Figure 4:
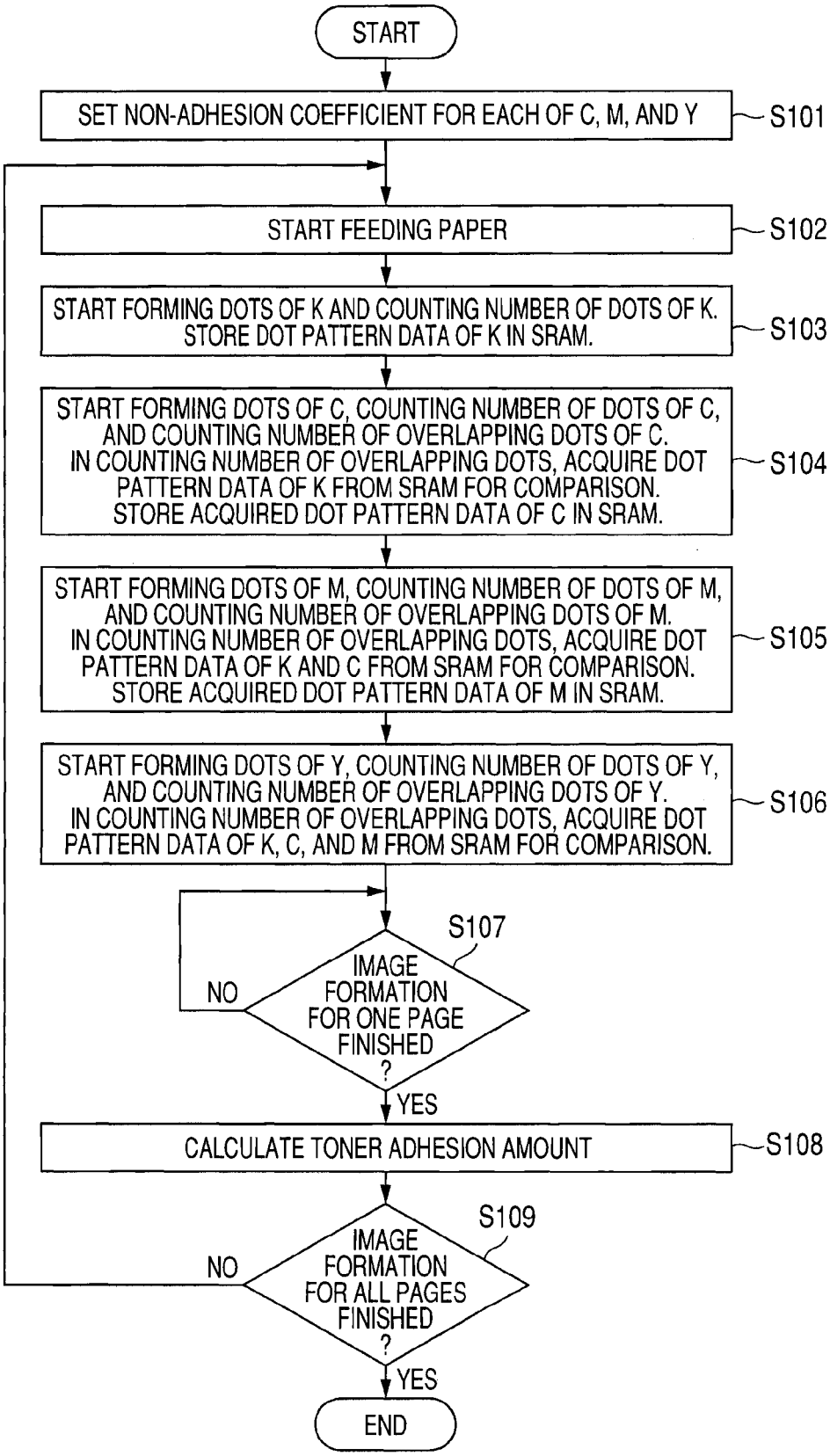
FIG. 4 is a flowchart showing an image forming process according to the first embodiment.

The flowchart of FIG. 4 shows a case where a toner adhesion amount is calculated for each of all the colors as the subject color.

In S101, the controller 41 sets a non-adhesion coefficient (an example of a weighting coefficient) for each of C, M, and Y.

The non-adhesion coefficient indicates a ratio of an amount of non-adhering toner when dots are overlappingly formed on other dots, to a toner adhesion amount for one dot that is estimated when dots are formed directly on paper 3.

For example, the non-adhesion coefficient is set to "0" if there is no non-adhering toner (in other words, the case in which all toner adheres), to "0.2" if 20% of toner does not adhere, and to "0.3" if 30% of toner does not adhere.

When dots are overlappingly formed on other dots, the amount of toner adhesion may differ depending on the color of dots formed over other dots. For example, the toner adhesion amount of C in the case when dots of C are formed on dots of K is sometimes different from the toner adhesion amount of M in the case when dots of M are formed on dots of K.

Hence, in the present embodiment, different non-adhesion coefficient are set for each color (C, M, and Y) of dots that are formed over other dots.

In S102, the controller 41 controls the paper conveying section 23 to start feeding paper.

In S103, the controller 41 starts forming dots of K and counting the number of dots of K. At this time, the controller 41 stores dot pattern data of K outputted from the CPU 20*a* in the SRAM 42.

In S104, the controller 41 starts forming dots of C and counting the number of dots of C, in a manner similar to dots of K. In addition, the controller 41 starts counting the number of overlapping dots of C. At this time, the controller 41 stores dot pattern data of C outputted from the CPU 20*a* in the SRAM 42.

In S105, the controller 41 starts forming dots of M and counting the number of dots of M, in a manner similar to dots of K. In addition, the controller 41 starts counting the number of overlapping dots of M, in a manner similar to dots of C. At this time, the controller 41 stores dot pattern data of M outputted from the CPU 20*a* in the SRAM 42.

There are cases where dots of C are overlappingly formed on dots of K, over which dots of M are overlappingly formed. In this way, a dot under which a plurality of dots are formed should not be counted multiply as an overlapping dot. For example, assume that a dot of M is counted as an overlapping dot as a result of comparison of dot pattern data of M and dot pattern data of K. In this case, even if the dot of M is overlapped with a dot of C as a result of comparison of dot pattern data of M and dot pattern data of C, the dot of M should not be counted again as an overlapping dot. The same goes for Y.

In S106, the controller 41 starts forming dots of Y and counting the number of dots of Y, in a manner similar to dots of K. In addition, the controller 41 starts counting the number of overlapping dots of Y, in a manner similar to dots of C and M. Note that dot pattern data of Y are not stored in the SRAM 42 because the dot pattern data of Y are not subsequently used for comparisons with dot pattern data of the other colors.

In S107, the controller 41 determines whether image formation of the first page of image data has been finished. If the controller 41 determines that the image formation has not been finished (S107: No), the controller 41 makes determination again after a predetermined time period elapses. If the controller 41 determines that the image formation has been finished (S107: Yes), the controller 41 proceeds to S108.

In S108, the controller 41 subtracts an estimated amount of non-adhering toner which is estimated based on the number of overlapping dots from an estimated amount of adhering toner which is estimated based on the number of dots of the subject color, thereby calculating the toner adhesion amount of the subject color.

Specifically, the controller 41 calculates the toner adhesion amount based on equations 1 through 4 shown below.

Toner adhesion amount of $K$=Number of dots of $K$×"Toner adhesion amount per dot which is estimated for the case where dots of $K$ are formed directly on paper" Equation 1

Toner adhesion amount of $C$=(Number of dots of $C$−Number of overlapping dots of $C$×Non-adhesion coefficient of $C$)×"Toner adhesion amount per dot which is estimated for the case where dots of $C$ are formed directly on paper" Equation 2

Toner adhesion amount of $M$=(Number of dots of $M$−Number of overlapping dots of $M$×Non-adhesion coefficient of $M$)×"Toner adhesion amount per dot which is estimated for the case where dots of $M$ are formed directly on paper" Equation 3

Toner adhesion amount of $Y$=(Number of dots of $Y$−Number of overlapping dots of $Y$×Non-adhesion coefficient of $Y$)×"Toner adhesion amount per dot which is estimated for the case where dots of $Y$ are formed directly on paper" Equation 4

In S109, the controller 41 determines whether image formation for all the pages of image data has been finished. If the controller 41 determines that image formation has not been finished for all the pages (S109: No), then the controller 41 returns to S102 to repeat the process until image formation for all the pages is finished (S109: Yes).

(5) Effects of the Embodiment

According to the laser printer 10 of the above-described first embodiment, if there are overlapping dots which are overlappingly formed on already-formed dots, an estimated amount of non-adhering toner estimated based on the number of overlapping dots is subtracted. Thus, a toner adhesion amount can be calculated more accurately.

Note that a calculated toner adhesion amount can be used, for example, as a control parameter for controlling temperature of the fixing unit 35 when a toner image is thermally fixed onto the surface of paper by the fixing unit 35. Additionally, the calculated toner adhesion amount could be used for changing bias voltages of the photosensitive drums 32, and/or for changing rotational speeds of the photosensitive drums 32.

According to the laser printer 10, different non-adhesion coefficients (weighting coefficients) are used for each of the subject colors. Hence, toner adhesion amounts can be estimated more accurately, when dots are overlappingly formed on already-formed dots and the toner adhesion amounts differ depending on colors.

Further, according to the laser printer 10, dot pattern data outputted from the CPU 20*a* are stored in the SRAM 42. Hence, it is unnecessary for the CPU 20*a* to reoutput dot pattern data of other colors when the number of overlapping dots of the subject color is counted, thereby shortening a time period required to count the number of overlapping dots.

Additionally, according to the laser printer 10, unnecessary dot pattern data stored in the SRAM 42 are overwritten (replaced) by dot pattern data that are outputted subsequently. Hence, the SRAM 42 can be used efficiently, thereby reducing the storage capacity of the SRAM 42.

Second Embodiment

Next, an image forming apparatus according to a second embodiment of the invention will be described while referring to FIGS. 5 and 6, wherein like parts and components are designated by the same reference numerals to avoid duplicating description.

In the second embodiment, the SRAM 42 is not provided. In the second embodiment, the number of dots and the number of overlapping dots of the subject color are counted within a period from when formation of dots on previous paper 3 ends until when formation of dots on subsequent paper 3 is started (this period is hereinafter referred to as "between-paper period").

Figure 5:
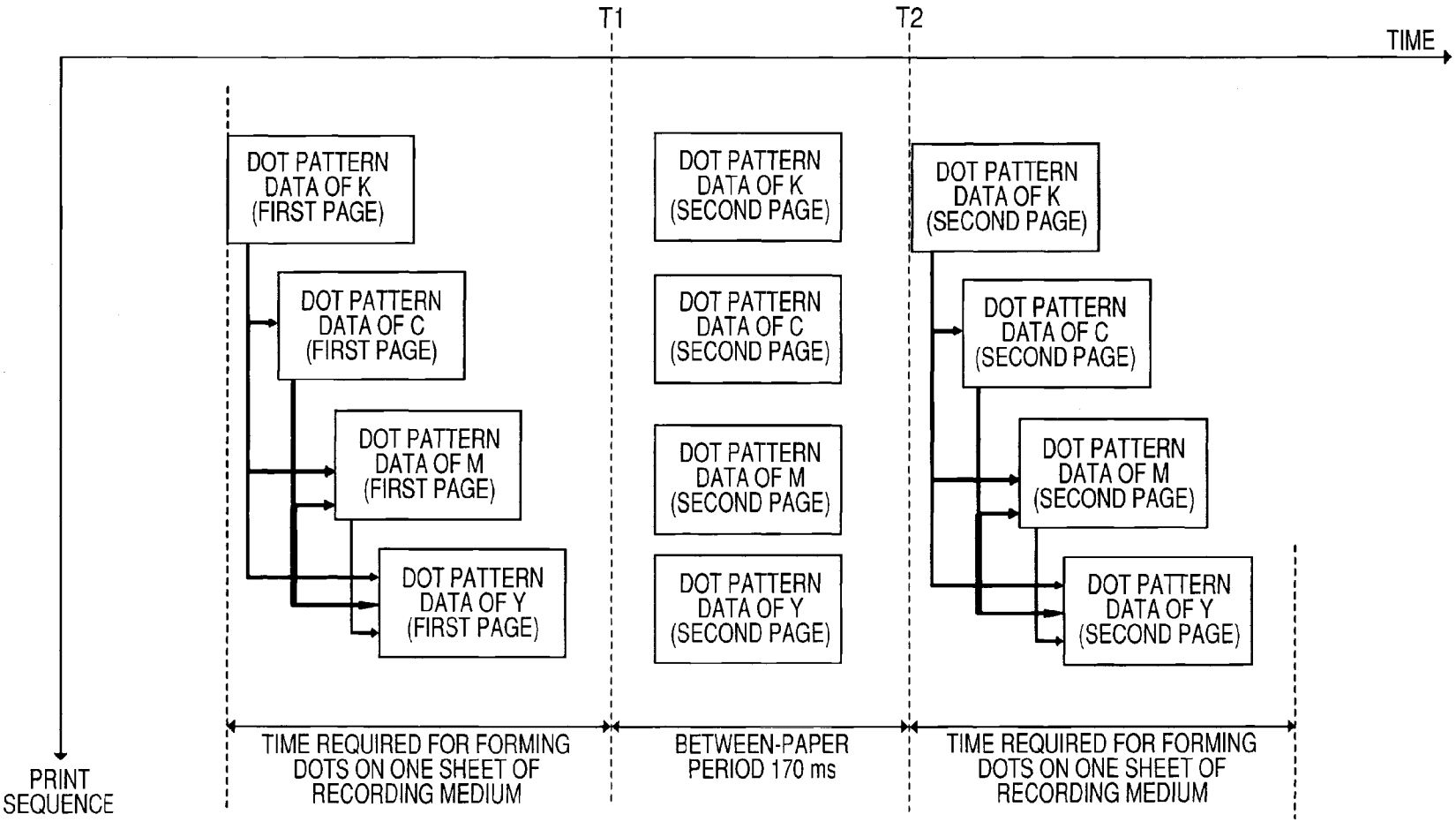
FIG. 5 is a timing chart of dot counting according to a second embodiment of the invention.

In FIG. 5, a time point T1 indicates a time point at which formation of dots on previous paper 3 ends, and a time point T2 indicates a time point at which formation of dots on subsequent paper 3 is started. The period from the time point T1 to the time point T2 (between-paper period) varies depending on the model of the printer or the like. Here, it is assumed that the between-paper period is 170 milliseconds.

An estimated time period for counting the number of overlapping dots of dot pattern data for four colors can be obtained as follows.

Assuming that the size of image data is A4 size, the amount of data of dots of dot pattern data (600 dpi) for one color is: 4960×7015=34794400 bits.

Assuming that one system clock is 10 nanoseconds (ns) and that the number of bits that can be processed in one system clock is 32 bits, the estimated time period is: (34794400/32)×10 ns=approximately 10 ms. Since the estimated time period for four colors is approximately 40 ms, counting can be sufficiently performed within the between-paper period of 170 ms.

Figure 6:
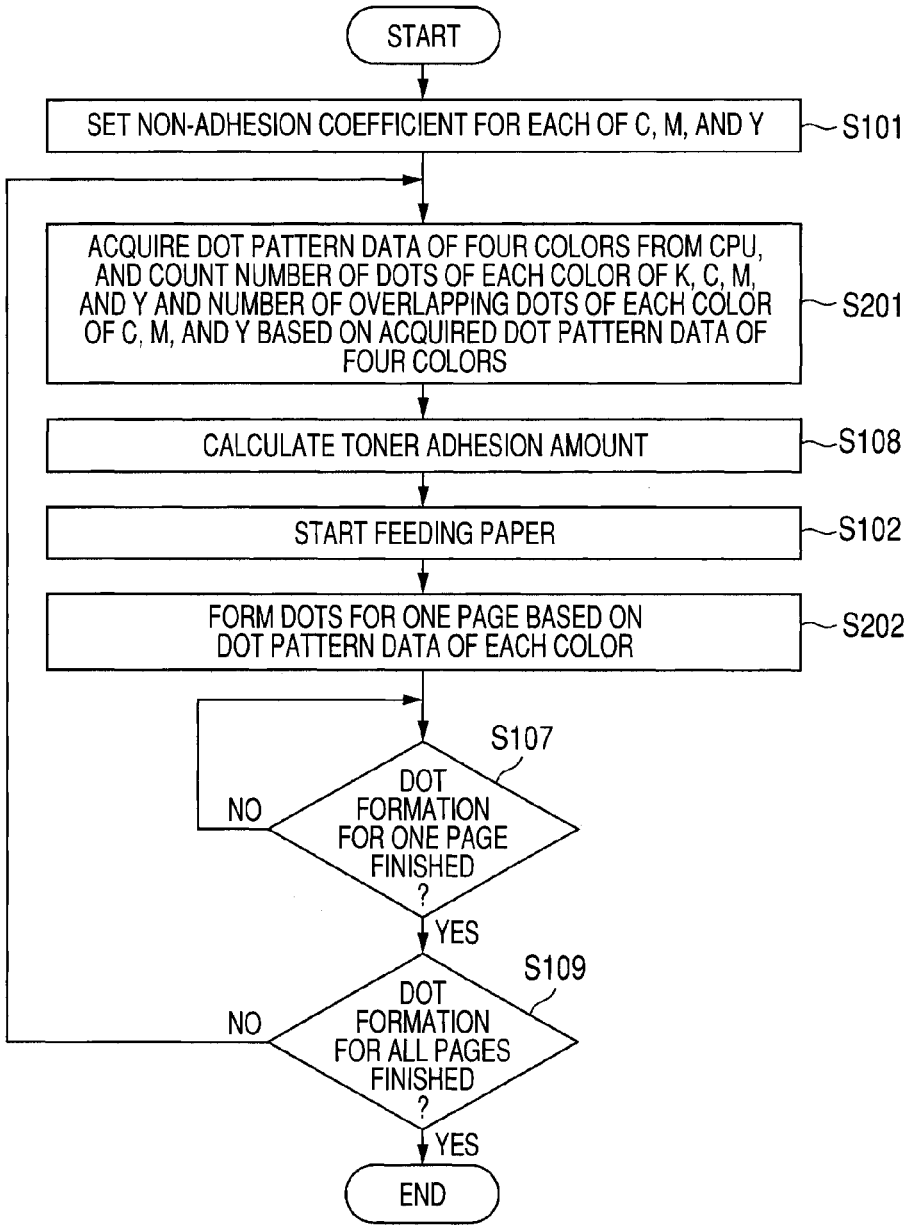
FIG. 6 is a flowchart showing an image forming process according to the second embodiment.

In the flowchart of FIG. 6, processes substantially identical to those in the first embodiment are designated by the same reference numerals to avoid duplicating description.

In S201, the controller 41 acquires dot pattern data of four colors from the CPU 20*a*, and counts the number of dots of each color of K, C, M, and Y and the number of overlapping dots of each color of C, M, and Y based on acquired dot pattern data of four colors. More specific description will be given below.

The controller 41 first outputs, to the CPU 20*a*, a predetermined data request signal which is different from the synchronization signal, thereby requesting output of dot pattern data for one line of K, C, M, and Y.

When a data request signal is outputted from the controller 41, the CPU 20*a* acquires dot pattern data of the first line from the respective dot pattern data of K, C, M, and Y and then outputs the dot pattern data to the controller 41. Each time a data request signal is outputted, the CPU 20*a* sequentially outputs dot pattern data for the subsequent one line from the respective dot pattern data.

Each time dot pattern data of each color for one line is outputted from the CPU 20*a*, the controller 41 counts the number of dots and the number of overlapping dots for each color based on the outputted dot pattern data for one line.

Next, the controller 41 again outputs a data request signal to the CPU 20*a* to request an output of dot pattern data for the subsequent one line. The controller 41 repeats this operation until no dot pattern data are outputted from the CPU 20*a*.

In this way, the number of dots of each color of K, C, M, and Y and the number of overlapping dots of each color of C, M, and Y are counted.

The process in S202 is substantially identical to the processes in S103 through S106, except that the number of dots and the number of overlapping dots are not counted. Hence, detailed descriptions are omitted.

According to the laser printer of the above-described second embodiment, counting is performed by using a period from when formation of dots on previous paper 3 ends until when formation of dots on subsequent paper 3 is started (the between-paper period). Hence, time can be spent efficiently.

Further, according to the laser printer of the second embodiment, because the SRAM 42 is unnecessary, the configuration for counting the number of overlapping dots can be simplified compared with the first embodiment. Additionally, counting can be sufficiently performed within the between-paper period. Thus, although the configuration for counting the number of overlapping dots is simplified, no delay occurs in forming dots or, if any delay occurs, counting can be performed with little delay.

Third Embodiment

Next, an image forming apparatus according to a third embodiment of the invention will be described while referring to FIGS. 7 and 8, wherein like parts and components are designated by the same reference numerals to avoid duplicating description.

In the third embodiment, too, the SRAM 42 is not provided. However, in the third embodiment, the number of dots and the number of overlapping dots of the subject color are counted during a period when dot pattern data for one line of the subject color are acquired from the CPU 20*a* and dots are formed, not in the between-paper period. Here, in the third embodiment, dot pattern data for one line of other colors for which dots are formed on the same line on paper 3 are reacquired from the CPU 20*a* to count the number of overlapping dots.

Figure 7:
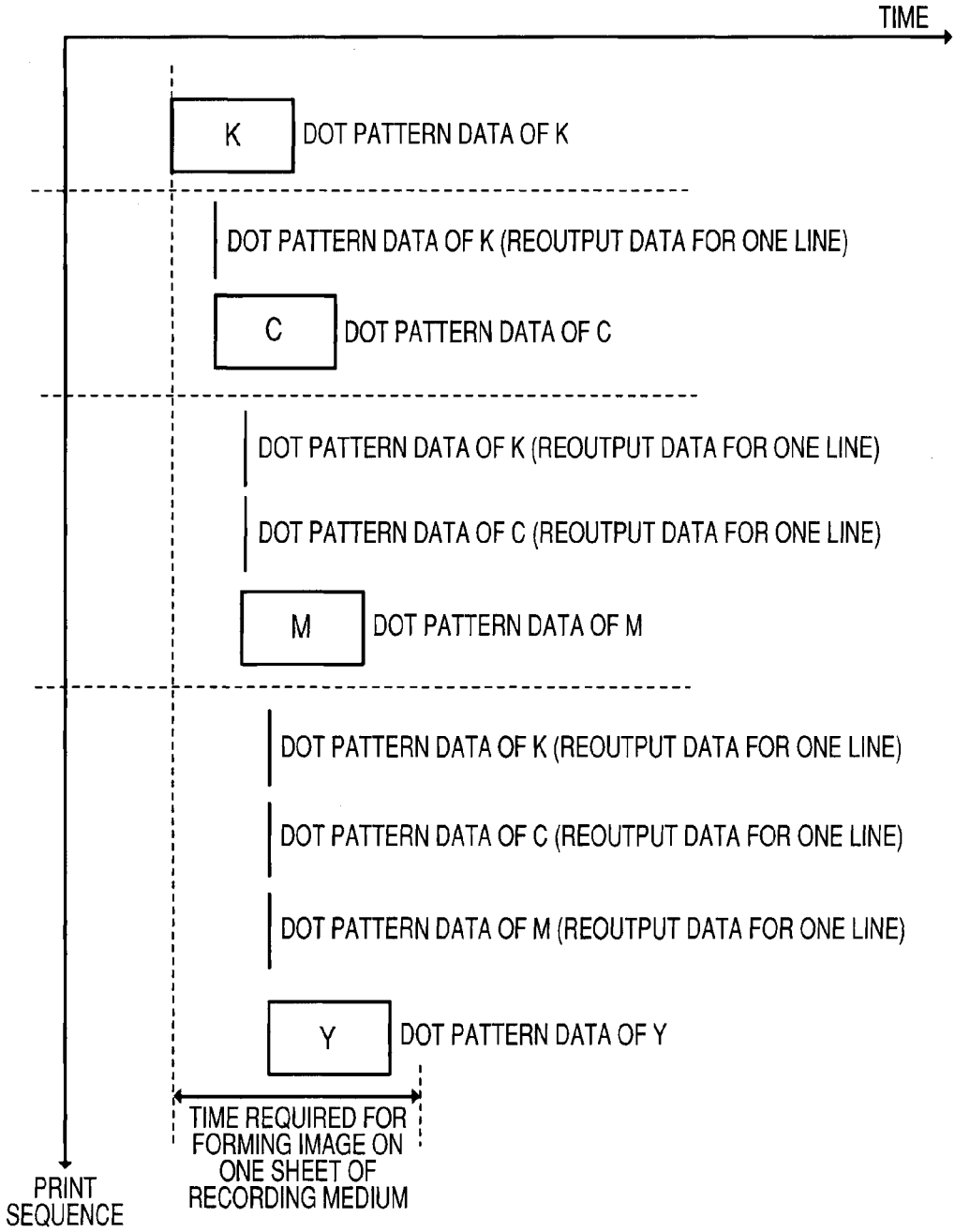
FIG. 7 is a timing chart of dot counting according to a third embodiment of the invention.

As shown in FIG. 7, when forming dots of dot pattern data of the first line of C, for example, the controller 41 requests the CPU 20*a* to reoutput of dot pattern data of the first line of K, compares dot pattern data of the first line of C with dot pattern data of the first line of K that is reoutputted from the CPU 20*a*, and counts the number of overlapping dots of C.

The same goes for the second line and thereafter, although it is omitted in FIG. 7. When forming dots of dot pattern data of the nth line of C, the controller 41 reacquires dot pattern data of the nth line of K from the CPU 20*a*, and counts the number of overlapping dots of C. Similar processes are used for Y and M.

Figure 8:
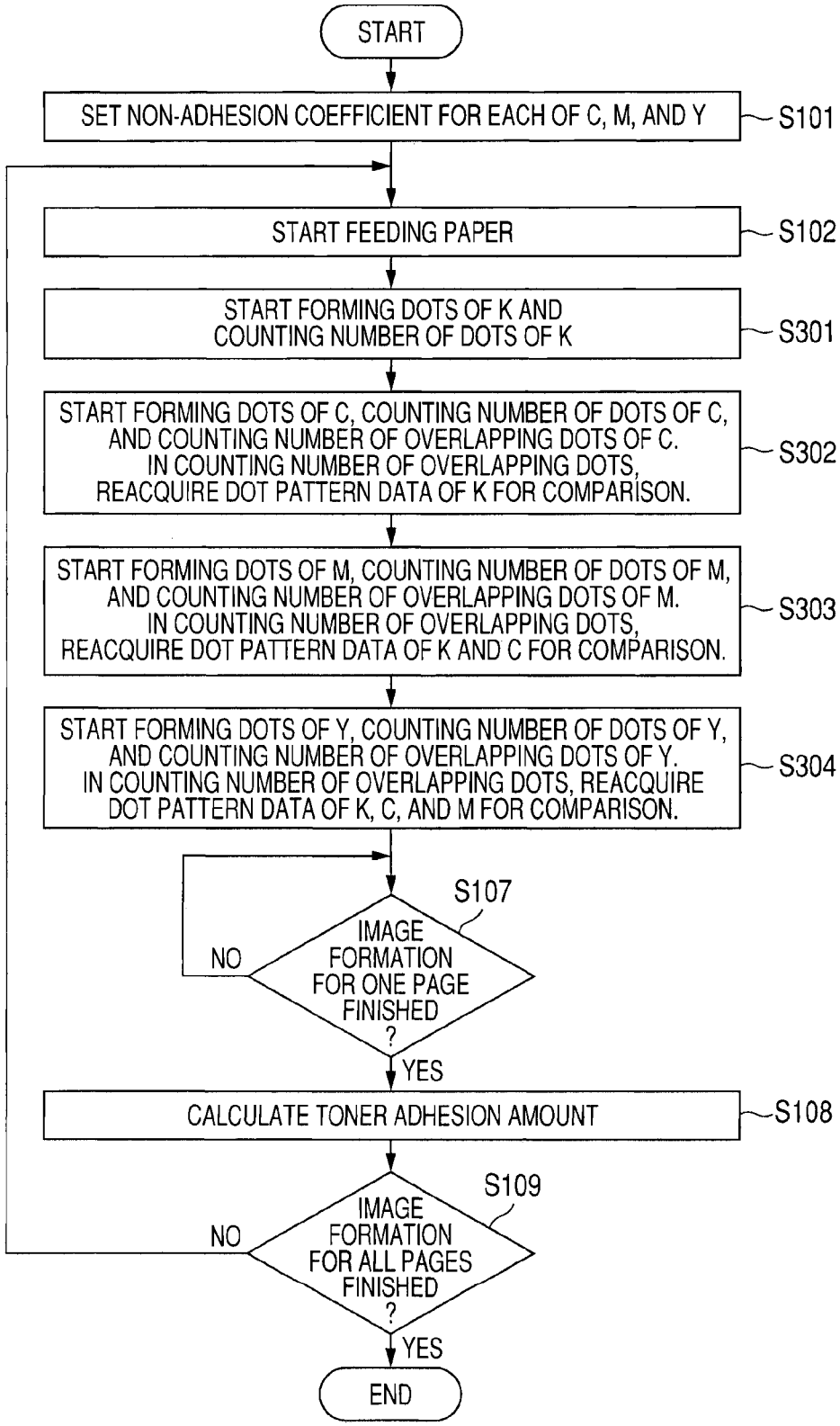
FIG. 8 is a flowchart showing an image forming process according to the third embodiment.

In the flowchart of FIG. 8, processes substantially identical to those in the first embodiment are designated by the same reference numerals to avoid duplicating description.

In S301, the controller 41 starts forming dots of K and counting the number of dots of K. In the third embodiment, dot pattern data used for forming dots are discarded, without storing in the SRAM 42. This is not limited to dot pattern data of K, but is the same for dot pattern data of C and M.

The process in S302 is substantially identical to the process in S104 in the first embodiment, except that reoutput of dot pattern data for one line of K from the CPU 20*a* is requested when counting the number of overlapping dots of C, without reading the dot pattern data from the SRAM 42, and that dot pattern data for one line used for forming dots are not stored in the SRAM 42.

Since the processes in S303 and S304 are similar to the process in S302, descriptions are omitted.

According to the laser printer of the above-described third embodiment, dot pattern data of other colors are reacquired from the CPU 20*a* when counting the number of overlapping dots of the subject color. Thus, it is unnecessary to provide the SRAM 42 to the controller 41 for storing dot pattern data outputted from the CPU 20*a*, thereby simplifying the configuration of the laser printer.

Fourth Embodiment

Next, an image forming apparatus according to a fourth embodiment of the invention will be described. In the fourth embodiment, the number of overlapping dots is counted by categorizing each of the overlapping dots based on the number of dots formed under the overlapping dot, where different non-adhesion coefficients by categories are used.

Taking Y as an example, the patterns in which dots of other colors are formed under a dot of Y include: the case in which three dots of K, C, and M are formed under a dot of Y; the case in which any two dots among K, C, and M are formed under a dot of Y; and the case in which any one dot among K, C, and M is formed under a dot of Y.

Generally, as the number of dots formed under a dot increases, adhesion of toner becomes more difficult. That is, toner adhesion amounts vary depending on the number of dots formed under a dot.

Hence, in the fourth embodiment, an overlapping dot is categorized based on the number of dots of other colors formed under the overlapping dot. Specifically, overlapping dots are categorized into an overlapping dot under which three dots are formed (referred to as "third-category dot"), an overlapping dot under which two dots are formed (referred to as "second-category dot"), and an overlapping dot under which one dot is formed (referred to as "first-category dot"). The number of overlapping dots are counted for each category.

Then, the toner adhesion amounts are calculated by using non-adhesion coefficients that are different depending on the category.

Specifically, taking Y as an example, a toner adhesion amount is calculated based on Equation 5 shown below.

Toner adhesion amount of $Y$={Number of dots of $Y$−(Number of third-category dots×Non-adhesion coefficient for third category+Number of second-category dots×Non-adhesion coefficient for second category+Number of first-category dots×Non-adhesion coefficient for first category)}×"Toner adhesion amount per dot which is estimated for the case where dots of $Y$ are formed directly on paper" Equation 5

Here, the following inequality is assumed: Non-adhesion coefficient for third category >Non-adhesion coefficient for second category >Non-adhesion coefficient for first category.

Here, although description has been given taking Y as an example, a similar method is applied to M.

According to the laser printer of the above-described fourth embodiment, the number of overlapping dots is counted by categorizing each of the overlapping dots based on the number of dots formed under the overlapping dot, where different non-adhesion coefficients by categories are used. Thus, the amount of non-adhering toner can be estimated more accurately.

Fifth Embodiment

Next, an image forming apparatus according to a fifth embodiment of the invention will be described while referring to FIG. 9.

Dots are not necessarily formed at the right positions at which the dots are supposed to be located, and are sometimes formed at positions deviated from the right positions. If a dot is formed on a position deviated from the right position and if dots of other colors exist around the right position, there is a possibility that the deviated dot overlaps with the dots of other colors which exist around the right position.

Hence, in the fifth embodiment, dots of other colors existing within a predetermined range of a dot of the subject color are detected for each dot of the subject color. Then, an expectation value is calculated as the number of overlapping dots, the expectation value being calculated based on probability that the dots in the subject color overlap with the detected dots of the other colors.

Figure 9:
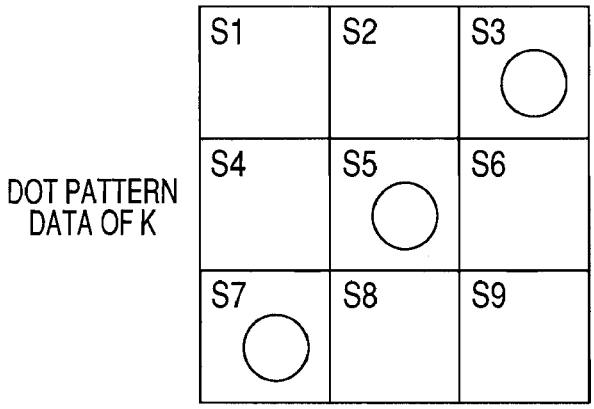
FIG. 9 is an explanatory diagram showing counting of overlapping dots according to a fifth embodiment of the invention.

An example of FIG. 9 shows the case where the number of overlapping dots of C is counted. More specifically, the example of FIG. 9 shows the situation in which dots of K are already formed at positions S3, S5, and S7, and a dot of C is about to be formed at the position S5.

When a dot of C is to be formed at the position S5, there is a possibility that the dot of C is formed at a deviated position, that is, a position other than the position S5. Here, it is assumed that probability that a dot of C is formed at positions S1-S9 is P1, P2, . . . , P9, respectively, where P1+P2+ . . . +P9=1. Probability P5 that the dot is formed at the position S5 is the largest, because the position S5 is the position at which the dot is supposed to be formed.

In the example shown in FIG. 9, an expectation value based on probability that a dot of C overlaps with dots of other colors can be obtained from the following equation.

$$\text{Expectation value}=P3\times1+P5\times1+P7\times1<1$$

Thus, in the present embodiment, an expectation value is calculated for each dot of C, the expectation value being calculated based on probability that the dot overlaps with dots of other colors. Then, the sum of the calculated expectation values is obtained as the number of overlapping dots of C. The number of overlapping dots of C (the sum of the expectation values calculated for each dot) is represented by Equation 6 shown below.

$$\text{Number of overlapping dots of } C=\text{“Number of dots of other colors located at } S1\text{”}\times P1+\text{“Number of dots of other colors located at } S2\text{”}\times P2+\ldots+\text{“Number of dots of other colors located at } S9\text{”}\times P9 \qquad \text{Equation 6}$$

Although the above explanation has been given taking C as an example, similar processes can be applied to M and Y. In the cases of M and Y, however, two or more dots of other colors may be formed at one position. In these cases, it should be assumed that only a dot formed over the other dots exists among the two or more dots of other colors, and that dots formed under the topmost dot do not exist, so that the expectation values are not summed up doubly or triply.

According to the laser printer of the above-described fifth embodiment, an expectation value is calculated as the number of overlapping dots, the expectation value being calculated based on probability that a dot of the subject color overlaps with dots of other colors existing within a predetermined range. Thus, even when a dot is not formed at a position at which the dot is supposed to be formed, the amount of non-adhering toner can be estimated more accurately.

Sixth Embodiment

Next, an image forming apparatus according to a sixth embodiment of the invention will be described while referring to FIG. 10.

In the sixth embodiment, like the fifth embodiment, an expectation value based on probability that a dot of the subject color overlaps with dots of other colors is calculated as the number of overlapping dots. Here, the number of overlapping dots is counted by categorizing each of the overlapping dots based on the number of dots formed under the overlapping dot, where different non-adhesion coefficients by categories are used.

Figure 10:
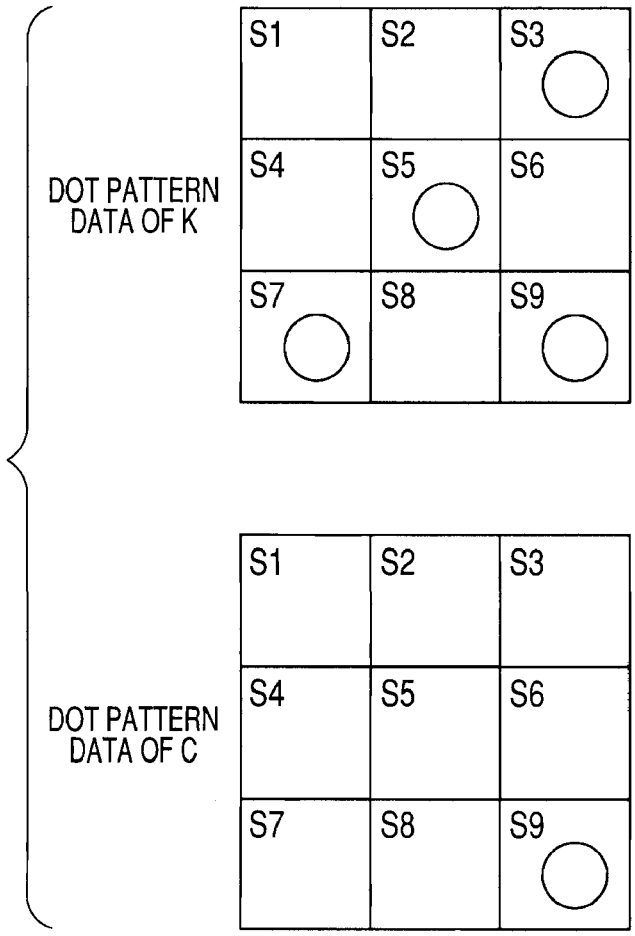
FIG. 10 is an explanatory diagram showing counting of overlapping dots according to a sixth embodiment of the invention.

An example of FIG. 10 shows the case in which dots of K are already formed at positions S3, S5, S7 and S9, and a dot of C is already formed overlappingly on the dot of K at the position S9, and a dot of M is about to be formed at the position S5.

As described earlier, when a dot is formed overlappingly on other dots, the toner adhesion amount varies depending on the number of dots formed under the dot. Hence, in the sixth embodiment, the number of dots is not simply counted by each position, but the number of dots is counted by each position and by the number of dots formed at the position.

Taking Y as an example, the results of calculating the number of overlapping dots are represented by Equations 7 through 9 shown below.

$$\text{Number of first-category overlapping dots}=\text{“Number of first-category dots at } S1\text{”}\times P1+\text{“Number of first-category dots at } S2\text{”}\times P2+\ldots+\text{“Number of first-category dots at } S9\text{”}\times P9 \qquad \text{Equation 7}$$

$$\text{Number of second-category overlapping dots}=\text{“Number of second-category dots at } S1\text{”}\times P1+\text{“Number of second-category dots at } S2\text{”}\times P2+\ldots+\text{“Number of second-category dots at } S9\text{”}\times P9 \qquad \text{Equation 8}$$

$$\text{Number of third-category overlapping dots}=\text{“Number of third-category dots at } S1\text{”}\times P1+\text{“Number of third-category dots at } S2\text{”}\times P2+\ldots+\text{“Number of third-category dots at } S9\text{”}\times P9 \qquad \text{Equation 9}$$

Then, the toner adhesion amount of Y can be represented as follows.

$$\text{Toner adhesion amount of } Y=\{\text{Number of dots of } Y-(\text{Number of first-category overlapping dots}\times\text{Non-adhesion coefficient for first category})-(\text{Number of second-category overlapping dots}\times\text{Non-adhesion coefficient for second category})-(\text{Number of third-category overlapping dots}\times\text{Non-adhesion coefficient for third category})\}\times\text{“Toner adhesion amount per dot which is estimated for the case where dots of } Y \text{ are formed directly on paper”} \qquad \text{Equation 10}$$

According to the laser printer of the above-described sixth embodiment, the number of overlapping dots is counted by categorizing each of the overlapping dots based on the number of dots formed under the overlapping dot, where different non-adhesion coefficients by categories are used. Thus, the amount of non-adhering toner can be estimated more accurately.

Modifications

While the invention has been described in detail with reference to the above aspects thereof, it would be apparent to those skilled in the art that various changes and modifications may be made therein without departing from the scope of the claims.

(1) For example, in the above-described embodiments, the controller 41 functions as the forming-dot counting section, the overlapping-dot counting section, and the calculating section. However, the CPU 20*a* may performs a part or all of these functions.

(2) In the first embodiment, different non-adhesion coefficients are used depending on the color (the subject color) of a dot that is overlappingly formed on other dots. However, different non-adhesion coefficients may be used depending on the color of a dot that is formed under a dot of the subject color. For example, the amounts of adhering toner may differ between the case where a dot of K (black) is formed under the dot of the subject color and the case where a dot of C (cyan) is formed under the dot of the subject color. Hence, the number of overlapping dots is counted by categorizing each of the overlapping dots based on the colors of dots formed under the overlapping dot, where different non-adhesion coefficients by categories are used.

Further, for example, different non-adhesion coefficients may be used for each of combinations of the color of a dot and the color of another dot formed overlappingly on the dot.

(3) In the second embodiment, the number of dots and the number of overlapping dots of the subject color are counted within a period from when formation of dots on previous paper 3 ends until when formation of dots on subsequent paper 3 is started (between-paper period). However, the image forming apparatus may be so configured that counting is performed within a between-paper period, like the second embodiment, if the between-paper period is relatively long, and that dot pattern data of other colors are reacquired from the CPU 20*a* when dot pattern data for one line of the subject color are acquired for forming dots, like the third embodiment, if the between-paper period is relatively short. Because counting is performed within a between-paper period if the between-paper period is relatively long, the between-paper period can be used efficiently. On the other hand, if the between-paper period is relatively short, dot pattern data of other colors are reacquired from the CPU 20*a* when dot pattern data for one line of the subject color are acquired for forming dots, thereby being able to count the number of overlapping dots even when there is not a sufficient between-paper period.

(4) In the above-described fifth and sixth embodiments, the nine positions P1-P9 are assumed. However, the number of the positions is not limited to nine.

What is claimed is:

1. An image forming apparatus comprising:

a first storage section that is configured to store dot pattern data generated for each of a plurality of colors of toner;

a dot forming section that is configured to form dots of each of the plurality of colors on a recording medium, based on the dot pattern data stored in the first storage section;

a forming-dot counting section that is configured to count a number of dots of a subject color based on the dot pattern data of the subject color, the subject color being a color for which an amount of toner adhering to the recording medium is calculated;

a overlapping-dot counting section that is configured to compare the dot pattern data of the subject color and the dot pattern data of at least one other color of which dots are formed prior to the subject color, and to count a number of overlapping dots of the subject color that are formed in an overlapping relation with the dots of the at least one other color; and a calculating section that is configured to calculate the amount of adhering toner of the subject color by subtracting an estimated amount of non-adhering toner from an estimated amount of adhering toner, the estimated amount of adhering toner being estimated based on the number of dots of the subject color, the estimated amount of non-adhering toner being estimated based on the number of overlapping dots.

2. The image forming apparatus according to claim 1, wherein the overlapping-dot counting section is configured to count the overlapping dots by categorization based on a number of dots formed under the overlapping dots; and wherein the calculating section is configured to estimate the estimated amount of non-adhering toner by multiplying the number of overlapping dots counted based on categorization by a weighting coefficient that is different by category.

3. The image forming apparatus according to claim 1, wherein the overlapping-dot counting section is configured to count the overlapping dots by categorization based on colors of dots formed under the overlapping dots; and wherein the calculating section is configured to estimate the estimated amount of non-adhering toner by multiplying the number of overlapping dots counted based on categorization by a weighting coefficient that is different by category.

4. The image forming apparatus according to claim 1, wherein the calculating section is configured to estimate the estimated amount of non-adhering toner by multiplying the counted number of overlapping dots by a weighting coefficient that is different by the subject color.

5. The image forming apparatus according to claim 1, further comprising:

an outputting section that is configured to read out the dot pattern data from the first storage section and to output the dot pattern data; and a second storage section that is configured to store the dot pattern data outputted by the outputting section as the dot pattern data of the at least one other color, wherein the overlapping-dot counting section is configured to read out the dot pattern data of the at least one other color from the second storage section and to count the number of overlapping dots of the subject color.

6. The image forming apparatus according to claim 5, wherein the outputting section is configured to output the dot pattern data sequentially by a predetermined number of lines; and wherein the overlapping-dot counting section is configured to control the second storage section to store the dot pattern data for the predetermined number of lines outputted by the outputting section and, when the dot pattern data for the predetermined number of lines stored in the second storage section become unnecessary, to replace the unnecessary dot pattern data for the predetermined number of lines with other dot pattern data for the predetermined number of lines that are subsequently outputted by the outputting section.

7. The image forming apparatus according to claim 1, wherein the overlapping-dot counting section is configured to count the number of overlapping dots of the subject color during a between-medium period from when the dot forming section finishes forming dots on a previous recording medium until when the dot forming section starts forming dots on a subsequent recording medium.

8. The image forming apparatus according to claim 1, wherein the overlapping-dot counting section is configured to reacquire the dot pattern data of the at least one other color from the first storage section and to count the number of overlapping dots of the subject color, when the dot forming section acquires the dot pattern data of the subject color from the first storage section and forms dots of the subject color.

9. The image forming apparatus according to claim 1, wherein the overlapping-dot counting section is configured, if a between-medium period is longer than or equal to a predetermined period, to count the number of overlapping dots of the subject color during the between-medium period that is a period from when the dot forming section finishes forming dots on a previous recording medium until when the dot forming section starts forming dots on a subsequent recording medium, and, if the between-medium period is shorter than the predetermined period, to reacquire the dot pattern data of the at least one other color from the first storage section and to count the number of overlapping dots of the subject color when the dot forming section acquires the dot pattern data of the subject color from the first storage section and forms dots of the subject color.

10. An image forming apparatus comprising:

a first storage section that is configured to store dot pattern data generated for each of a plurality of colors of toner;

a dot forming section that is configured to form dots of each of the plurality of colors on a recording medium, based on the dot pattern data stored in the first storage section;

a forming-dot counting section that is configured to count a number of dots of a subject color based on the dot pattern data of the subject color, the subject color being a color for which an amount of toner adhering to the recording medium is calculated;

a overlapping-dot counting section that is configured to compare the dot pattern data of the subject color and the dot pattern data of at least one other color of which dots are formed prior to the subject color, to detect dots of the at least one other color that exist within predetermined ranges of respective dots of the subject color, and to count an expectation value based on probability that the respective dots of the subject color overlap with detected dots of the at least one other color as a number of overlapping dots; and a calculating section that is configured to calculate the amount of adhering toner of the subject color by subtracting an estimated amount of non-adhering toner from an estimated amount of adhering toner, the estimated amount of adhering toner being estimated based on the number of dots of the subject color, the estimated amount of non-adhering toner being estimated based on the number of overlapping dots.

11. The image forming apparatus according to claim 10, wherein the overlapping-dot counting section is configured to count the overlapping dots by categorization based on a number of dots formed under the overlapping dots; and wherein the calculating section is configured to estimate the estimated amount of non-adhering toner by multiplying the number of overlapping dots counted based on categorization by a weighting coefficient that is different by category.

12. The image forming apparatus according to claim 10, wherein the overlapping-dot counting section is configured to count the overlapping dots by categorization based on colors of dots formed under the overlapping dots; and wherein the calculating section is configured to estimate the estimated amount of non-adhering toner by multiplying the number of overlapping dots counted based on categorization by a weighting coefficient that is different by category.

13. The image forming apparatus according to claim 10, wherein the calculating section is configured to estimate the estimated amount of non-adhering toner by multiplying the counted number of overlapping dots by a weighting coefficient that is different by the subject color.

14. The image forming apparatus according to claim 10, further comprising:

an outputting section that is configured to read out the dot pattern data from the first storage section and to output the dot pattern data; and a second storage section that is configured to store the dot pattern data outputted by the outputting section as the dot pattern data of the at least one other color, wherein the overlapping-dot counting section is configured to read out the dot pattern data of the at least one other color from the second storage section and to count the number of overlapping dots of the subject color.

15. The image forming apparatus according to claim 14, wherein the outputting section is configured to output the dot pattern data sequentially by a predetermined number of lines; and wherein the overlapping-dot counting section is configured to control the second storage section to store the dot pattern data for the predetermined number of lines outputted by the outputting section and, when the dot pattern data for the predetermined number of lines stored in the second storage section become unnecessary, to replace the unnecessary dot pattern data for the predetermined number of lines with other dot pattern data for the predetermined number of lines that are subsequently outputted by the outputting section.

16. The image forming apparatus according to claim 10, wherein the overlapping-dot counting section is configured to count the number of overlapping dots of the subject color during a between-medium period from when the dot forming section finishes forming dots on a previous recording medium until when the dot forming section starts forming dots on a subsequent recording medium.

17. The image forming apparatus according to claim 10, wherein the overlapping-dot counting section is configured to reacquire the dot pattern data of the at least one other color from the first storage section and to count the number of overlapping dots of the subject color, when the dot forming section acquires the dot pattern data of the subject color from the first storage section and forms dots of the subject color.

18. The image forming apparatus according to claim 10, wherein the overlapping-dot counting section is configured, if a between-medium period is longer than or equal to a predetermined period, to count the number of overlapping dots of the subject color during the between-medium period that is a period from when the dot forming section finishes forming dots on a previous recording medium until when the dot forming section starts forming dots on a subsequent recording medium, and, if the between-medium period is shorter than the predetermined period, to reacquire the dot pattern data of the at least one other color from the first storage section and to count the number of overlapping dots of the subject color when the dot forming section acquires the dot pattern data of the subject color from the first storage section and forms dots of the subject color.

19. An image forming apparatus comprising:

first storage means for storing dot pattern data generated for each of a plurality of colors of toner;

dot forming means for forming dots of each of the plurality of colors on a recording medium, based on the dot pattern data stored in the first storage means;

forming-dot counting means for counting a number of dots of a subject color based on the dot pattern data of the subject color, the subject color being a color for which an amount of toner adhering to the recording medium is calculated;

overlapping-dot counting means for comparing the dot pattern data of the subject color and the dot pattern data of at least one other color of which dots are formed prior to the subject color, and for counting a number of overlapping dots of the subject color that are formed in an overlapping relation with the dots of the at least one other color; and calculating means for calculating the amount of adhering toner of the subject color by subtracting an estimated amount of non-adhering toner from an estimated amount of adhering toner, the estimated amount of adhering toner being estimated based on the number of dots of the subject color, the estimated amount of non-adhering toner being estimated based on the number of overlapping dots.

* * * * *